US007097163B2

(12) United States Patent
Moriyama et al.

(10) Patent No.: US 7,097,163 B2
(45) Date of Patent: Aug. 29, 2006

(54) DEVICE FOR CONTROLLING CHOKE VALVE OF CARBURETOR

(75) Inventors: Hiroshi Moriyama, Saitama (JP); Takashi Suzuki, Saitama (JP); Tetsuya Arai, Saitama (JP); Takanori Sato, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/069,592

(22) Filed: Mar. 2, 2005

(65) Prior Publication Data

US 2005/0194701 A1 Sep. 8, 2005

(30) Foreign Application Priority Data

Mar. 3, 2004 (JP) ..... 2004-058760
Mar. 3, 2004 (JP) ..... 2004-058769
Apr. 12, 2004 (JP) ..... 2004-116909
Apr. 12, 2004 (JP) ..... 2004-116912

(51) Int. Cl.
*F02M 7/06* (2006.01)

(52) U.S. Cl. ..... 261/52; 123/179.18; 261/64.6

(58) Field of Classification Search ..... 261/39.1–39.6, 261/52, 64.6; 123/376, 438, 179.18
See application file for complete search history.

(56) References Cited

U.S. PATENT DOCUMENTS 2,410,758 A * 11/1946 Thompson ..... 261/39.3
2,998,233 A * 8/1961 Marsee ..... 261/39.3
3,284,061 A * 11/1966 Gordon ..... 261/39.3
3,321,193 A * 5/1967 Highley ..... 261/39.3
3,789,814 A * 2/1974 Gilham et al. ..... 261/39.3
3,886,917 A * 6/1975 Nakada et al. ..... 261/39.4
4,297,980 A * 11/1981 Bellis ..... 123/438
4,331,615 A * 5/1982 Walstra et al. ..... 261/39.4
4,463,723 A * 8/1984 Tansuwan ..... 123/438

(Continued)

FOREIGN PATENT DOCUMENTS

JP 42-25 1/1967

(Continued)

*Primary Examiner*—Richard L. Chiesa
(74) *Attorney, Agent, or Firm*—Arent Fox, PLLC

(57) ABSTRACT

A device for controlling a choke valve of a carburetor for an engine, includes a choke closed state hold device for holding, in a closing position, a choke lever connected to the choke valve of a carburetor and urged by a spring in a direction for opening the choke valve, when the choke lever is turned to the closing position, the choke closed state hold device releasing the choke lever from the held state by a throttle operation of the carburetor after a start of the engine. The choke closed state hold device includes a lock arm provided continuously with a throttle lever and a locked arm provided continuously with the choke lever, the lock arm and the locked arm elastically surmounting each other when the choke lever is turned to the closing position in a state where the throttle lever is in the opening position corresponding to a full open position of the throttle valve, so that the lock arm prevents the locked arm from turning back. Thus, the choke closed state hold device is constituted only by the lock arm and the locked arm respectively provided continuously with the throttle lever and the choke lever, and there is no need for a lock lever specially supported axially on the carburetor as in the conventional arrangement. Therefore, the number of components is reduced, and the construction is simplified, so that the manufacturing cost of the choke valve control device can be reduced.

3 Claims, 16 Drawing Sheets

BRAKING STATE (LOW-TEMPERATURE STOPPED STATE OF ENGINE)

U.S. PATENT DOCUMENTS

| | | | | | |
|---|---|---|---|---|---|
| 4,465,640 | A | * | 8/1984 | Dougherty | 261/39.3 |
| 5,069,180 | A | * | 12/1991 | Schmidt et al. | 123/376 |
| 5,660,765 | A | * | 8/1997 | King et al. | 261/39.3 |
| 5,915,355 | A | * | 6/1999 | Andreasson | 123/336 |
| 6,722,638 | B1 | * | 4/2004 | Kojima et al. | 261/39.2 |
| 2005/0022798 | A1 | * | 2/2005 | Roth et al. | 123/676 |
| 2005/0194700 | A1 | * | 9/2005 | Moriyama et al. | 261/39.4 |
| 2005/0194701 | A1 | * | 9/2005 | Moriyama et al. | 261/39.4 |

FOREIGN PATENT DOCUMENTS

| | | | | |
|---|---|---|---|---|
| JP | 60-30459 | * | 2/1985 | 261/39.4 |
| JP | 6-147012 | * | 5/1994 | 261/39.3 |

* cited by examiner

BRAKING STATE (LOW-TEMPERATURE STOPPED STATE OF ENGINE)

BRAKING STATE (LOW-TEMPERATURE STOPPED STATE OF ENGINE)

BRAKE RELEASE (BEFORE START OF ENGINE AT LOW TEMPERATURE)

BRAKE RELEASE (BEFORE START OF ENGINE AT LOW TEMPERATURE)

AT START OF ENGINE AT LOW TEMPERATURE

WARM-UP OPERATION STATE

WARM-UP OPERATION STATE

WHEN WARM-UP OPERATION IS FINISHED

WHEN WARM-UP OPERATION IS FINISHED

HIGH-TEMPERATURE STOPPED STATE OF ENGINE (BRAKING STATE)

DEVICE FOR CONTROLLING CHOKE VALVE OF CARBURETOR

RELATED APPLICATION DATA

The Japanese priority application Nos. 2004-58760, 2004-58769, 2004-116909 and 2004-116912 upon which the present application is based are hereby incorporated in their entirety herein by reference.

BACKGROUND OF THE INVENTION

1. Field of the Invention

The present invention relates to an improvement in a device for controlling a choke valve of a carburetor annexed to an engine, the device having a choke closed state hold means for holding, in a closing position corresponding to the completely closed position of the choke valve, a choke lever connected to the choke valve and urged by a spring in a direction for opening the choke valve, when the choke lever is turned to the closing position, the choke closed state hold means releasing the choke lever from the held state by a throttle operation of the carburetor after a start of the engine.

2. Description of the Related Art

Such a carburetor choke valve control device is disclosed, for example, in Japanese Utility Model Publication No. 42-25.

In the conventional carburetor choke valve control device, the choke closed state hold means is constituted by a throttle lever connected to a throttle valve, a choke lever connected to a choke valve, a lock lever which, when the throttle lever is in the opening position corresponding to the fully opening position of the throttle valve, holds the choke lever in the closing position by locking the choke lever with an acceleration lever while being axially supported on the carburetor, when the choke lever is turned to the closing position, and a lock spring which urges the lock lever in the locking direction. The conventional carburetor choke valve control device therefore has a large number of components and is comparatively complicated in construction, leading to a hindrance in reducing the manufacturing cost.

SUMMARY OF THE INVENTION

The present invention has been achieved in view of the above-mentioned circumstances, and has an object to provide a low-priced carburetor choke valve control device in which the structure of the choke closed state hold means is simplified.

In order to achieve the above-mentioned object, according to a first feature of the invention, there is provided a device for controlling a choke valve of a carburetor annexed to an engine, comprising choke closed state hold means for holding, in a closing position corresponding to the completely closed position of the choke valve, a choke lever connected to the choke valve and urged by a spring in a direction for opening the choke valve, when the choke lever is turned to the closing position, the choke closed state hold means releasing the choke lever from the held state by a throttle operation of the carburetor after a start of the engine, wherein the choke closed state hold means includes a lock arm provided continuously with a throttle lever connected to a throttle valve of the carburetor, and a locked arm provided continuously with the choke lever, the lock arm and the locked arm elastically surmounting each other when the choke lever is turned to the closing position in a state where the throttle lever is in the opening position corresponding to a full open position of the throttle valve, so that the lock arm prevents the locked arm from turning back; a governor spring which urges the throttle lever in a direction for opening the throttle valve and a governor which produces an output for urging the throttle lever in a direction for closing the throttle valve according to an increase in the rotational speed of the engine are connected to the throttle lever; and the lock arm releases the locked arm by turning of the throttle lever in the direction for closing the throttle lever by the output from the governor.

With the first feature, the choke closed state hold means is constituted only by the lock arm and the locked arm respectively provided continuously with the throttle lever and the choke lever, and there is no need for a lock lever specially supported axially on the carburetor as in the conventional arrangement. Thus, the number of components is reduced, and the construction is simplified, so that the manufacturing cost of the choke valve control device can be reduced.

After a start of the engine, the choke lever is released from the closing position by the closing operation of the throttle lever through the operation of the governor. Thus, release of the choke lever and, hence, opening of the choke valve can be automatically performed.

According to a second feature of the present invention, in addition to the first feature, the device further comprises a braking mechanism for stopping the rotation of an output shaft of the engine; brake release means manually operated so as to release the braking mechanism from the operating state; a choke spring which urges the choke valve in the direction for opening the valve, and which is connected to the choke valve; automatic choke valve opening means for automatically opening, in cooperation with the choke spring, after a start of the engine, the choke valve held in the closed position immediately before the start of the engine, the automatic choke valve opening means being also connected to the choke valve; and automatic choke valve closing means for turning the choke valve to the closed position in interlock with the operation of the brake release means, the automatic choke valve closing means being provided between the choke valve and the brake release means.

With the second feature, the choke valve can be closed by being interlocked with the brake release means. Therefore, it is not necessary for an operator to touch the choke lever when starting the engine, thereby preventing erroneous start of the engine by the operator forgetting closing the choke valve.

According to a third feature of the present invention, in addition to the second feature, the automatic choke closing means includes a first control lever which is axially supported on a fixed structural member of the engine, and which turns to a first position and a second position by being interlocked with nonoperative and operative states of the brake release means, and a second control lever which is axially supported on the fixed structural member, and which, when the first control lever turns to the second position, is thereby driven to turn the choke lever connected to the choke valve to the position for closing the choke valve and is thereafter released from the first control lever; the device further comprising a return spring which urges the second control lever in a direction for opening the choke valve and which is connected to the second control lever, and lost motion means for leaving the choke lever in the closing position when the second control lever is returned by the return spring, the lost motion means being provided between the second control lever and the choke lever.

With the third feature, the first control lever turns the choke lever to the choke valve closing position through the second control lever with the operation of the brake release means, and thereafter releases the second control lever. The released second control lever leaves the choke lever in the choke valve closing position, thus generating a fuel-rich air-fuel mixture at the time of starting of the engine to improve the startability.

The above-mentioned object, other objects, characteristics and advantages of the present invention will become apparent from an explanation of preferred embodiments, which will be described in detail below by reference to the attached drawings.

DESCRIPTION OF THE PREFERRED EMBODIMENTS

Preferred embodiments of the present invention will be described with reference to the accompanying drawings.

Figure 1:
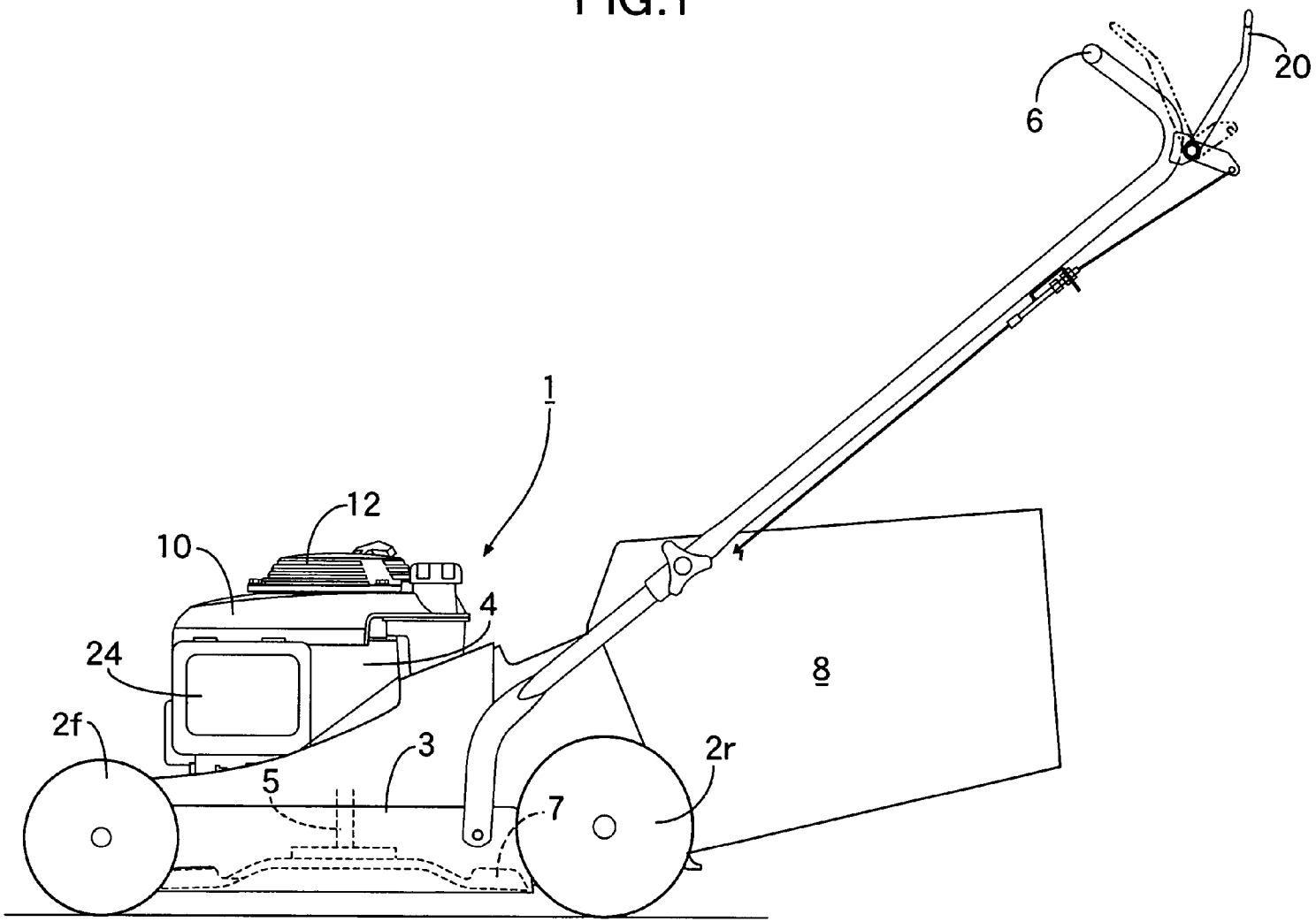
FIG. 1 is a side view of a power lawn mower in which an engine having a choke valve control device according to a first embodiment of the present invention is mounted.

Description will be first made to the first embodiment of the present invention. Referring to FIG. 1, a walking-type lawn mower 1, which is a power working machine, has a housing 3 supported by front wheels 2*f* and rear wheels 2*r*. A vertical engine 4 having a crankshaft 5 is mounted on an upper surface of the housing 3, with its crankshaft 5 vertically positioned. Rotary mowing blades 7 are provided in the housing 3 by being attached to the lower end of the crankshaft 5. A glass bag 8 is attached to an operating handle 6 connected to a rear end portion of the housing 3. Lawn grass clipped by the mowing blades 7 is collected in the glass bag 8.

Referring to FIGS. 2 to 5, a flywheel 9 which functions as a cooling fan is fixed to the upper end of the crankshaft 5 of the engine 4; and an engine cover 10 which, as well as the flywheel 9, covers an upper surface of the engine 4, is fixed on the engine 4. In the engine cover 10, a recoil-type starter 11 capable of driving the crankshaft 5 through the flywheel 9, and a starter cover 12 covering the starter 11 are mounted. A large number of cooling air intake openings 13 are provided in the starter cover 12 to draw cooling air into the engine cover 10 through the cooling air intake openings 13 during rotation of the flywheel 9, i.e., the cooling fan. Cooling air is led to each portion of the engine 4 by the engine cover 4. Reference symbol 11*a* in FIG. 2 denotes a rope pulling grip of the starter 11.

A brake shoe 16 which cooperates with a cylindrical peripheral surface of the flywheel 9 is mounted by means of a pivot 17 on a bracket 14 fixed on the engine 4 below the flywheel 9. The pivot 17 is placed at an inner position relative to the outer peripheral surface of the flywheel 9.

The brake shoe 16 has an arm 16*a* extending between the bracket 14 and the flywheel 9 to an outer position relative to the peripheral surface of the flywheel 9, and a pressure contact portion 16*b* bent from the outer end of the arm 16*a* and facing the peripheral surface of the flywheel 9. A lining 18 is bonded to the pressure contact portion 16*b*.

The brake shoe 16 can swingably move about the pivot 17 between a braking position A (see FIGS. 4 and 5) at which the lining 18 on the pressure contact portion 16*b* is pressed against the peripheral surface of the flywheel 9, and a brake release position B (see FIG. 6) at which the lining 18 is apart from the peripheral surface of the flywheel 9. A brake spring 19 which urges the brake shoe 16 toward the braking position A is connected to the front end of the pressure contact portion 16*b* of the brake shoe 16. The brake shoe 16, the flywheel 9 and the brake spring 19 constitute a braking mechanism 15 stopping the rotation of the crankshaft 5.

An operating arm 16*c* is formed integrally with the brake shoe 16. An operating wire 21 operated by being pulled by a brake release lever 20 (see FIG. 1) axially supported on the operating handle 6 is connected to the operating arm 16*c* at the extreme end thereof. When the operating wire 21 is pulled, the brake shoe 16 can be turned to the brake release position B by means of the operating arm 16*c*.

Figure 4:
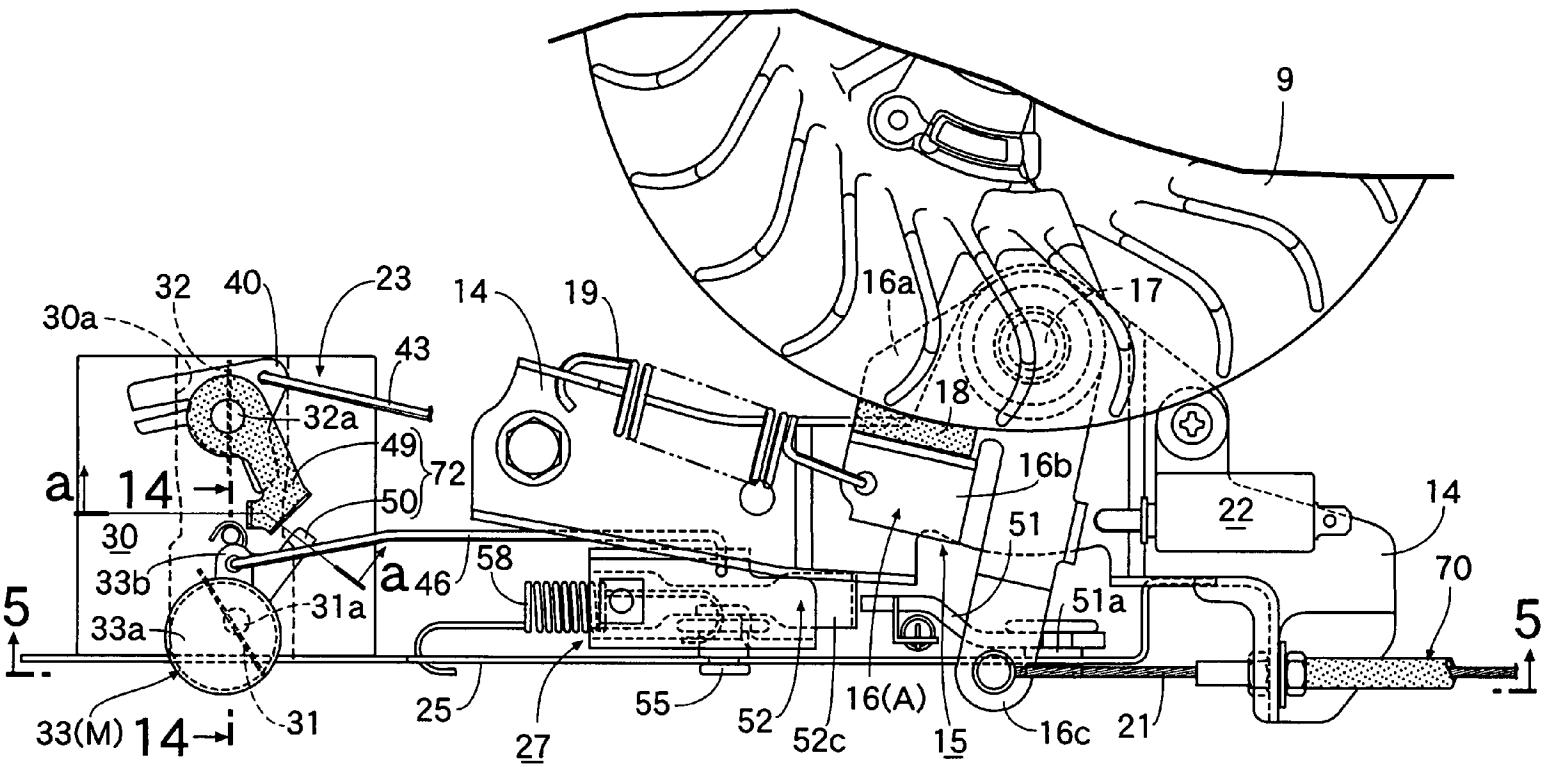
FIG. 4 is an enlarged diagram of an essential portion of FIG. 2.

As shown in FIG. 4, an engine kill switch 22 is provided on an upper surface of the bracket 14. The engine kill switch 22 makes an engine ignition circuit (not shown) nonoperative in interlock with a turn of the brake shoe 16 to the braking position A to stop the operation of the engine 4.

Figure 2:
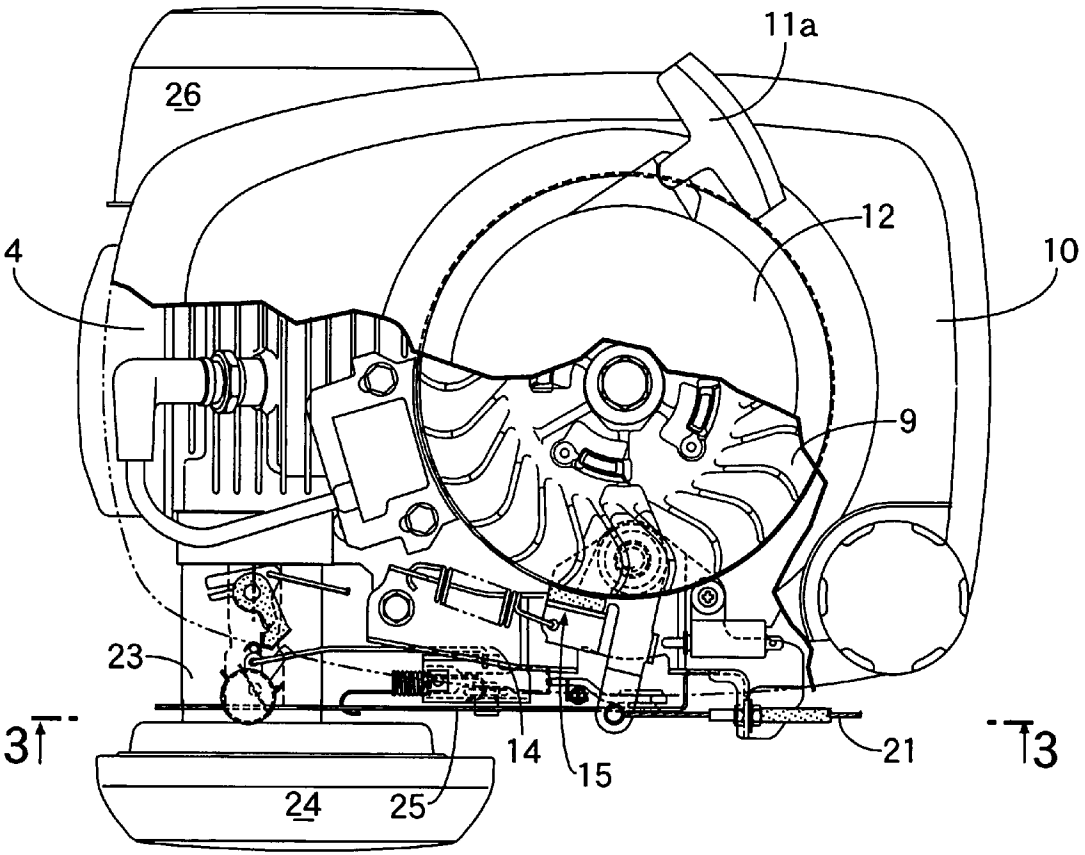
FIG. 2 is a partially fragmentary plan view of the engine.
Figure 3:
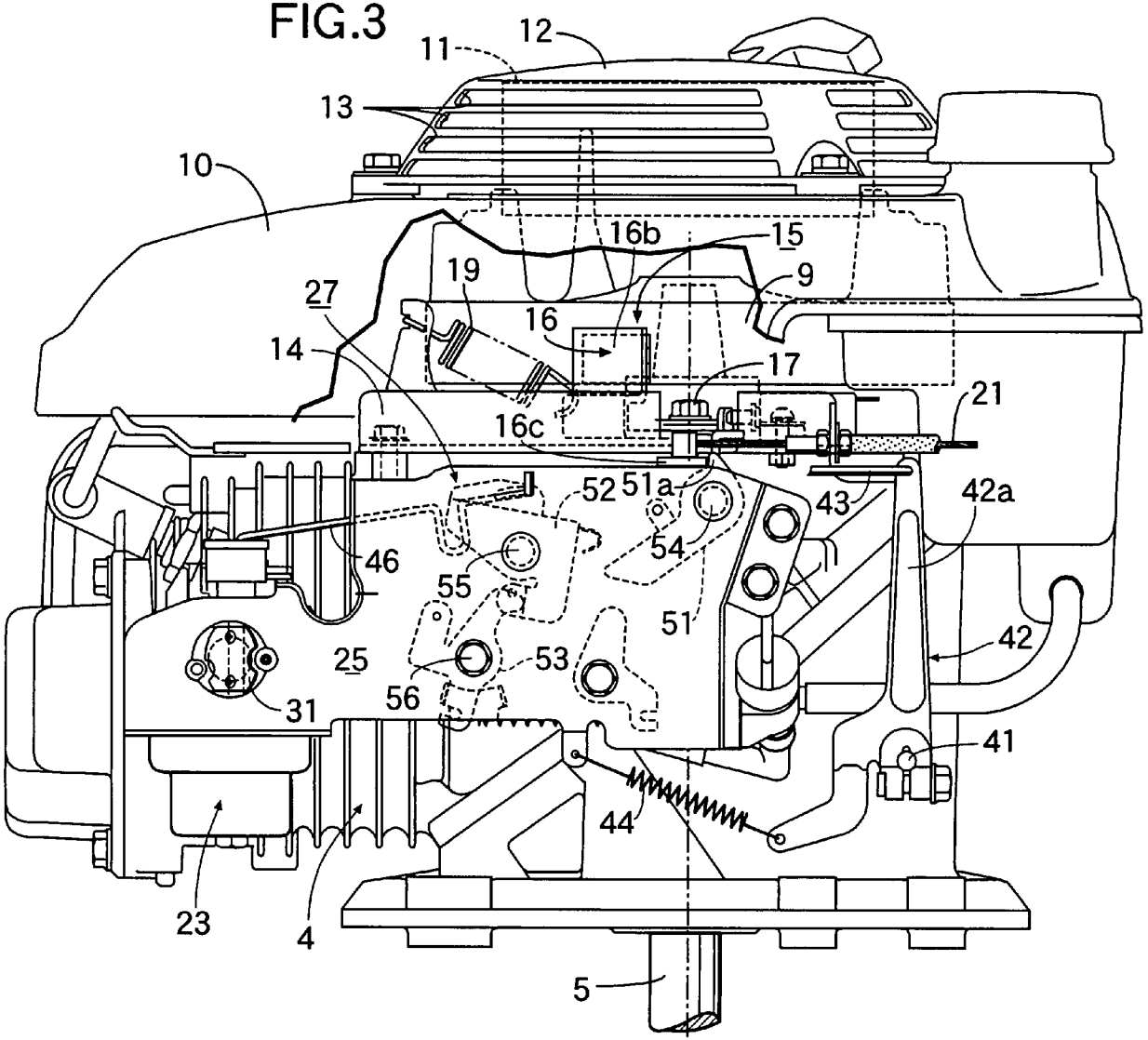
FIG. 3 is a sectional view taken along line 3—3 of FIG. 2.

As shown in FIGS. 2 to 4, a carburetor 23 is mounted on the engine 4 on the left or right side of the engine 4, while an exhaust muffler 26 is mounted on the engine 4 on the right or left side. An air cleaner 24 is connected to an upstream end of the carburetor 23.

The carburetor 23 includes a carburetor body 30 having an intake path 30*a*, a butterfly-type choke valve 31 for opening and closing an upstream portion of the intake path 30*a*, and a butterfly-type throttle valve 32 for opening and closing the intake path 30*a* on the downstream side. Valve shafts 31*a* and 32*a* of the choke valve 31 and the throttle valve 32 are rotatably supported on the carburetor body 30 while being vertically positioned, as is the crankshaft 5 of the engine 4.

Figure 14:
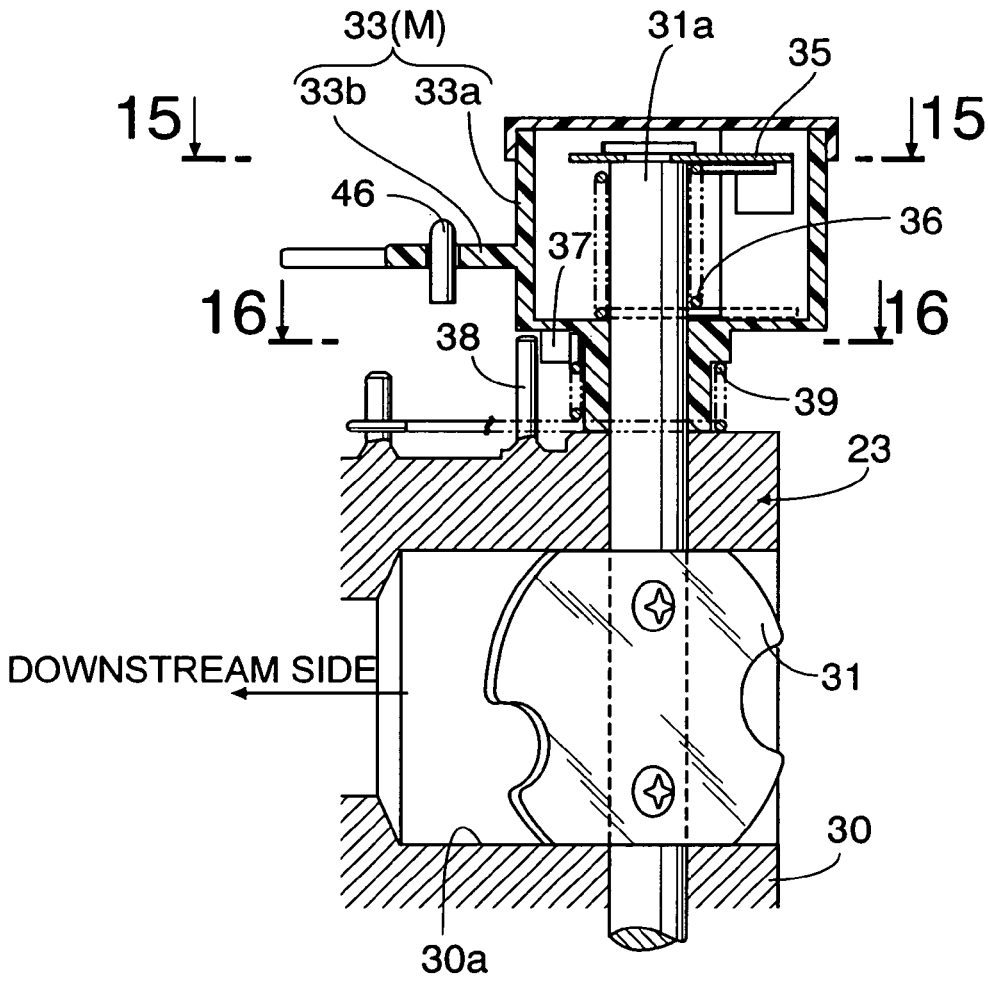
FIG. 14 is a sectional view taken along line 14—14 of FIG. 4.
Figure 15:
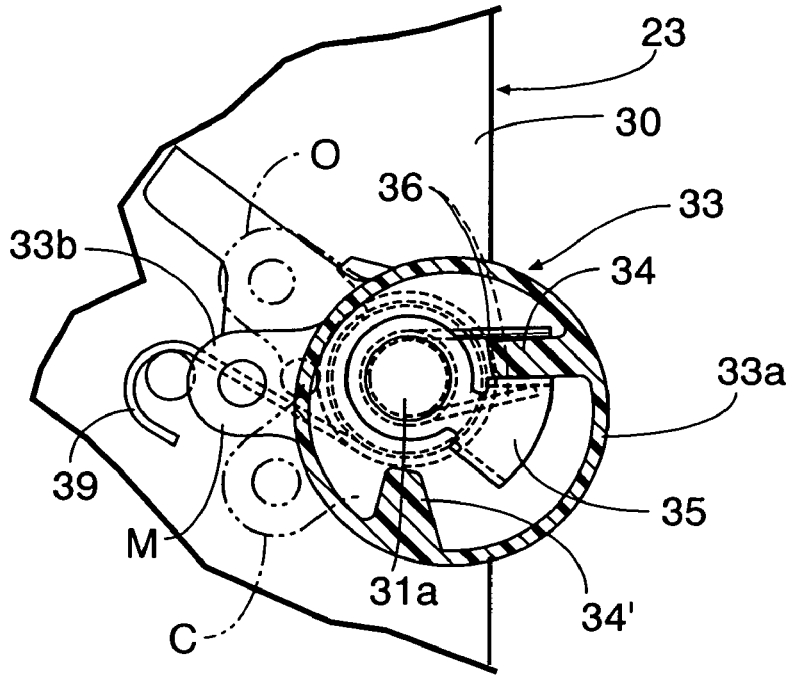
FIG. 15 is a sectional view taken along line 15—15 of FIG. 14.
Figure 16:
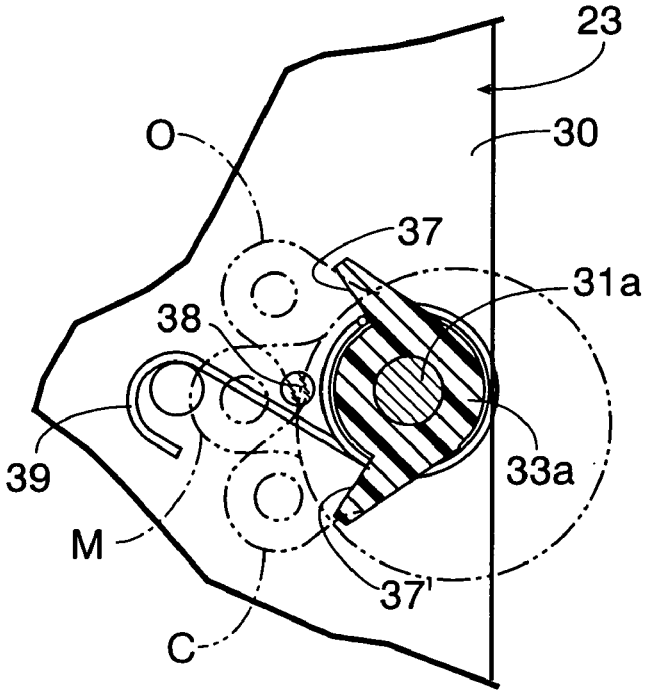
FIG. 16 is a sectional view taken along line 16—16 of FIG. 15.

As shown in FIGS. 14 to 16, the valve shaft 31*a* of the choke valve 31 is offset from a center line of the intake path 30*a* on one side thereof, and is tilted from the center line of the intake path 30*a* so that, in its completely closed state, its larger-radius portion is placed downstream relative to its smaller-radius portion in the intake path 30*a*. A choke lever 33 is attached to an outer end portion of the valve shaft 31*a* projecting outside the carburetor body 30. The choke lever 33 has a hub 33*a* which is a bottomed cylindrical member rotatably fitted around the valve shaft 31*a*, and a lever arm 33*b* formed integrally with the hub 33*a* so as to project from one side surface of the hub 33*a*. A pair of stopper projections 34 and 34' are formed inside the hub 33*a* in a state of being spaced apart from each other through a certain distance along the circumferential direction of the hub 33*a*. A relief lever 35 turnable only between the stopper projections 34 and 34' is fixed to the valve shaft 31*a*, and a relief spring 36 which urges the relief lever 35 so that the relief lever 34 is brought into contact with the stopper 34 positioned on the closing side of the choke valve 31 is provided between the hub 33*a* and the relief lever 35.

A pair of stopper walls 37 and 37' are formed on an outer circumferential surface of a lower part of the hub 33*a* in a state of being spaced apart from each other through a certain distance along the circumferential direction of the hub 33*a*. A stopper pin 38 is formed on an outer surface of the carburetor body 30 so as to project therefrom to be placed between the stopper walls 37 and 37'.

The closing position C of the choke lever 33 at which the choke valve 31 is completely closed is determined by the contact of one stopper wall 37 with the stopper pin 38, and the opening position O of the choke lever 33 at which the choke valve 31 is fully opened is determined by the contact of the other stopper wall 37' with the stopper pin 38.

If the negative suction pressure of the engine exceeds a certain value when the degree of opening of the choke valve 31 is zero or small, the difference between the moment of rotation due to the negative suction pressure acting on the larger-radius portion of the choke valve 31 and the moment of rotation due to the negative function pressure acting on the smaller-radius portion of the choke valve 31 prevails the moment of rotation caused by the relief spring 36, to thereby increase the degree of opening of the choke valve 31. The increase in the degree of opening is limited by the contact of the relief lever 35 with the other stopper projection 34'.

Referring again to FIGS. 4 and 5, a throttle lever 40 is fixed to an outer end portion of the valve shaft 32*a* of the throttle valve 32 projecting outside the carburetor body 30, and a long arm portion 42*a* of a governor lever 42 fixed to an outer end portion of a rotary support shaft supported on the engine 4 is connected to the throttle lever 40 by a link 43. A governor spring 44 which urges the governor lever 42 in the throttle valve 32 opening direction by a certain load is also connected to the governor lever 42. Further, an output shaft 45*a* of a well-known centrifugal governor 45 driven by the crankshaft 5 of the engine 4 is linked to a short arm portion 42*b* of the governor lever 42. The output from the centrifugal governor 45 which increases with the increase in the rotational speed of the engine 4 acts on the short arm portion 42*b* in the throttle valve 32 closing direction through the output shaft 45*a*. When the engine 4 is in an operation stopped state, the throttle lever 40 is held at the throttle valve 32 closing position C by the set load of the governor spring 44. During the operation of the engine 4, the degree of opening of the throttle valve 32 is automatically controlled by balancing between the moment of the governor lever 42 due to the output from the centrifugal governor 45 and the moment of the governor lever 42 due to the load of the governor spring 44.

A choke valve control device 27 according to an embodiment of the present invention, which automatically opens and closes the choke valve 31, will now be described.

Figure 5:
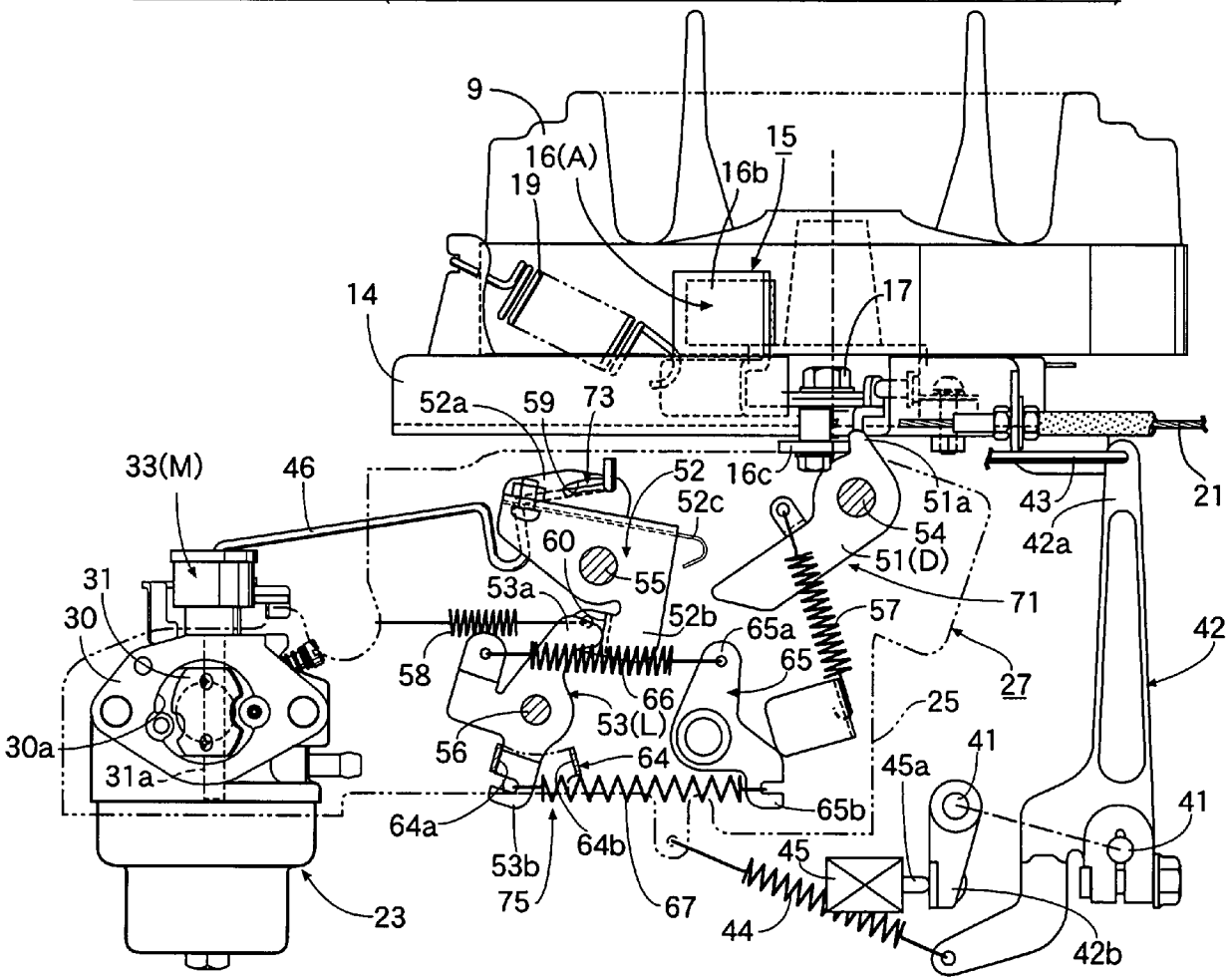
FIG. 5 is a sectional view taken along line 5—5 of FIG. 4 (showing the operating state of the braking mechanism).

Referring to FIGS. 3 to 5, a supporting plate 25 combined with the bracket 14 and extending vertically is interposed between the carburetor 23 and the air cleaner 24. On the inner surface of the supporting plate 25, first to third control levers 51 to 53 are rotatably mounted by first to third pivots 54 to 56. The second control lever 52 is placed between the first control lever 51 and the carburetor 23, and the third control lever 53 is placed immediately below the second control lever 52.

The first control lever 51 has an end extending toward the second control lever 52, and a claw portion 51*a* which is formed on its base portion and which engages with and disengages from a front edge of the release arm 16*c* when the brake shoe 16 is in the braking position A. A first return spring 57 which urges the claw portion 51*a* in the direction for engagement with the release arm 16*c* is connected to the first control lever 51. The first control lever 51 turns between a first position D at which the claw portion 51*a* contacts the front end of the release arm 16*c* at the braking position A, and a second position E at which the release arm 16*c* presses the claw portion 51*a* after being turned to the brake release position B.

The second control lever 52 has upper and lower arm portions 52*a* and 52*b* extending upward and downward, respectively, from the second pivot 55, and an elastic arm portion 52*c* extending toward the first control lever 51 and having flexibility. A circular-arc elongated hole 59 concentric with the second pivot 55 is provided in the upper arm portion 52*a*. One end of a link 46 having the other end slidably fitted in the elongated hole 59 is connected to an end portion of the lever arm 33*b* of the choke lever 33. The elastic arm portion 52*c* is pushed by the first control lever 51 when the first control lever 51 turns from the first position D to the second position E. By this pushing, the second control lever 52 turns the choke lever 33 to the closing position C through the link 46.

A contact wall 60 is formed on the lower arm portion 52*b* of the second control lever 52 to rise along the axial direction of the second pivot 55. A second return spring 58 which urges the second control lever 52 in such a direction that the contact wall 60 is brought into contact with an upper arm portion 53*a* of the third control lever 53 described below, is stretched between a second control lever 52 and the supporting plate 25.

Figure 17A:
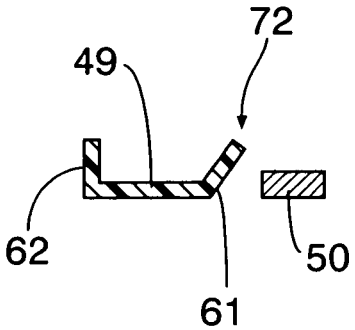
FIGS. 17A to 17C are diagrams for explaining a means for holding the choke lever in the closing position, FIG. 17A being a sectional view taken along line a—a of FIG. 4, FIG. 17C being a sectional view taken along line c—c of FIG. 7.
Figure 17B:
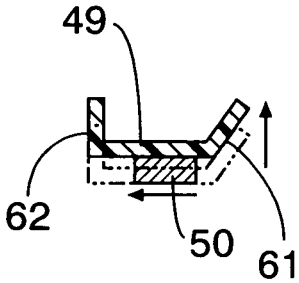
Figure 17C:
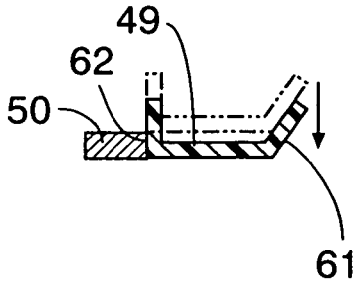

The throttle lever 40 has a lock arm 49 having elasticity for bending in the axial direction of the valve shaft 32*a*. A locked arm 50 provided in correspondence with the lock arm 49 is integrally formed on the choke lever 33. The locked arm 50 is held by the lock arm 49 when the choke lever 33 is turned to the closing position C in the state where the throttle valve 32 is fully opened. That is, as shown in FIGS. 17A to 17C, the lock arm 49 enters the turning path for the locked arm 50 when the throttle lever 40 is in the full-open position. A sloping surface 61 is formed in the lock arm 49 at one side in the turning direction so that the sloping surface 61 is pressed and lifted by the locked arm 50 when the locked arm 50 turns the choke lever 33 to the closing position C. A contact surface 62 which receives the locked arm 50 to hold the choke lever 33 in the closing position C immediately after the locked arm 50 has passed below the lock arm 49 is formed at the other side.

Referring again to FIGS. 4 and 5, the third control lever 53 has upper and lower arm portions 53*a* and 53*b* extending upward and downward, respectively, from the third pivot 56. An extreme end of the upper arm portion 53*a* is brought into contact with the contact wall 60 of the lower arm portion 52*b* of the second control lever 52 from the carburetor 23 side.

A stopper member 64 having first and second stopper walls 64*a* and 64*b* for limiting the turn angle of the third control lever 53 by receiving the lower arm portion 53*b*, is fixed on the supporting plate 25. The position of the third control lever 53 when the lower arm portion 53*b* is brought into contact with the first stopper wall 64*a* on the carburetor 23 side will be referred to as a low-temperature position L, and the position of the third control lever 53 when the lower arm portion 53*b* is brought into contact with the second stopper wall 64*b* opposite from the carburetor 23 will be referred to as a high-temperature position H.

Further, a spring engagement member 65 juxtaposed with the third control lever 53 on the side opposite from the carburetor 23 is fixed on the supporting plate 25 so that the third control lever 53 is disposed between the spring engagement member 65 and the carburetor 23. The spring engagement member 65 also has upper and lower arm portions 65*a* and 65*b* corresponding to the upper and lower arm portions 53*a* and 53*b* of the third control lever 53. Opposite ends of a first control spring 66 formed of a tensile coil spring are connected to the upper arm portions 53*a* and 65*a*, while opposite ends of the second control spring 67 formed of a tensile coil spring are connected to the lower arm portions 53*b* and 65*b*. The set load of the first control spring 66 is set higher than that of the second return spring 58.

The second control spring 67 is made of a shape memory alloy. The second control spring 67 loses its spring function at a temperature lower than a shape restoration temperature corresponding to the ambient temperature at the end of warm-up operation of the engine 4, but exerts a set load (tensile force) higher than that of the first control spring 66 at a temperature equal to or higher than the shape restoration temperature.

In the above-described arrangement, the brake release lever 20, the operating wire 21 and the release arm 16*c* constitute brake release means 70 for releasing the brake shoe 16 from the state of braking the flywheel 9; the first and second control levers 51 and 52 and the link 46 constitute automatic choke closing means 71 for turning the choke lever 33 to the closing position C in interlock with the operation of the brake release means 70; the lock arm 49 and the locked arm 50 constitute choke valve closed state hold means 72 for holding the choke lever 33 in the closing position C; the link 46 and the elongated hole 59 constitute lost motion means 73 for allowing a return of the second control lever 52 caused by the second return spring after the choke lever 33 has been held in the closing position C; the second return spring 58, the third control lever 53, the first stopper wall 64*a* and the first control spring 66 constitute warm-up control means 74 for holding the choke lever 33 in a state of half opening the choke valve 31; and the third control lever 53, the second stopper wall 64*b* and the second control spring 67 constitute automatic choke opening means 75 for turning the choke lever 33 to the opening position O after the completion of warm-up operation of the engine 4.

The operation of the first embodiment will now be described.

As shown in FIGS. 3 to 5, in a state where the brake shoe 16 is in the braking position A, braking the flywheel 9 to maintain the engine 4 in the stopped state, the first control lever 51 is held in the first position D, with the claw portion 51*a* maintained in engagement with the front edge of the release arm 16*c* by the urging force of the first return spring 57. Also, the second control lever 52 has the contact wall 60 of the lower arm portion 52*b* brought into contact with the extreme end of the upper arm portion 53*a* of the third control lever 53 by the urging force of the second return spring 58. However, if the engine 4 is in a low-temperature condition, the ambient temperature is lower than the shape restoration temperature of the second control spring 67, so that the second control spring 67 loses the spring function. Therefore, the third control lever 53 is held in the low-temperature position L, with its lower arm portion 53*b* maintained in contact with the first stopper wall 64*a* by the urging force of the first control spring 66, and with its upper arm portion 53*a* receiving the lower arm portion 52*b* of the second control lever 52 at the position remotest from the carburetor 23.

On the other hand, in the carburetor 23, the choke lever 33 is urged by the urging force of the choke spring 39 to turn in the choke valve 31 opening direction, but the choke valve 31 is held in a half opened state by the contact of the link 46 with one inner end wall of the elongated hole 59 of the upper arm portion 52*a* of the second control lever 52.

Figure 6:
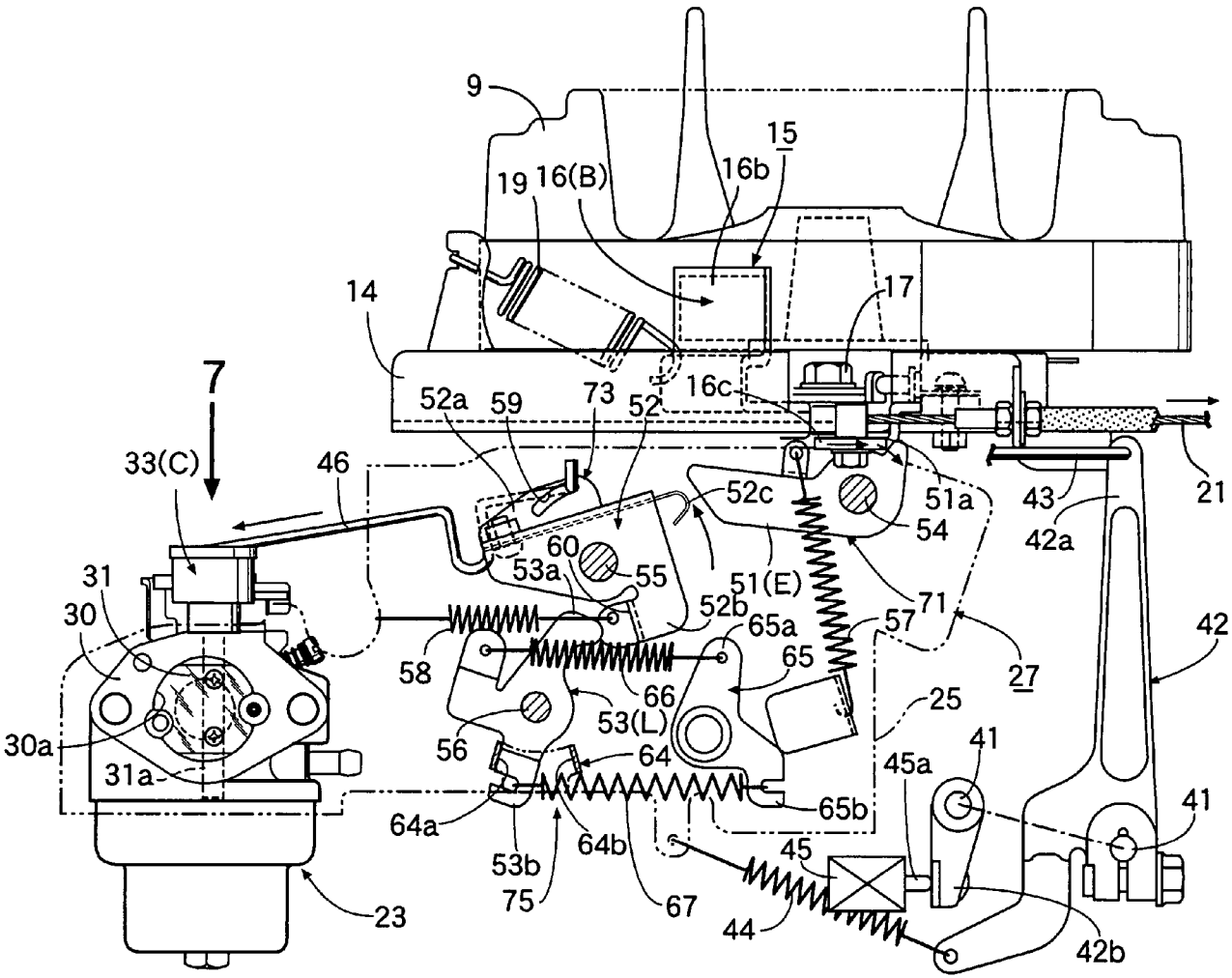
FIG. 6 is a diagram corresponding to FIG. 5, showing brake release by the braking mechanism and the state of the mechanism before a start of the engine at a low temperature.
Figure 7:
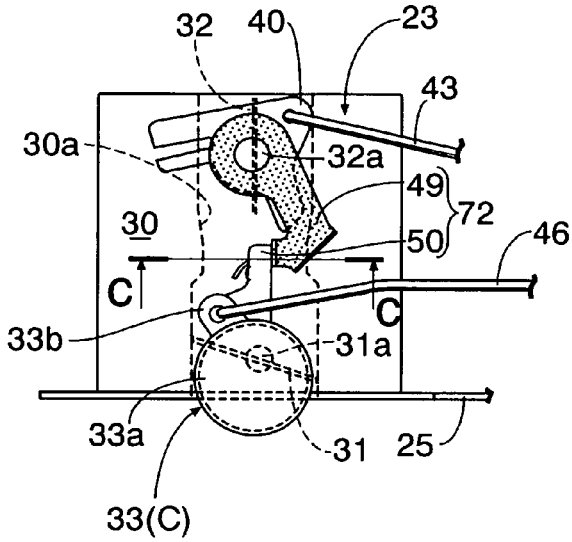
FIG. 7 is a diagram in the direction of the arrow 7 in FIG. 6.

To operate the power lawn mower 1, the operating wire 21 is first pulled by gripping the brake release lever 20 together with the operating handle 6 to operate the release arm 16*c*. The brake shoe 16 is thereby turned to the brake release position B to release the force for braking the flywheel 9. The crankshaft 5 is thereby made free. At this time, engine kill switch 22 is made nonoperative by the brake shoe 16 (the ignition circuit is made operative). The release arm 16*c* of the brake shoe 16 simultaneously turns clockwise the claw portion 51*a*, i.e., the first control lever 51, as shown in FIG. 6. The first control lever 51 thereby turns counterclockwise the elastic arm portion 52*c*, i.e., the second control lever 52. With this turning, the second control lever 52 presses the link 46 to turn the choke lever 33 to the closing position C, as shown in FIG. 7. At the same time, the locked arm 50 formed integrally with the choke lever 33 slides on the sloping surface 61 of the lock arm 49 of the throttle lever 40 and wedges away the lock arm 49 to cause the same to temporarily bend upward (see FIG. 17B), to pass below the lock arm 49. After the passage of the locked arm 50, the lock arm 49 returns to the original state and the contact surface 62 is brought into contact with the locked arm 50 (see FIG. 17C), thereby holding the choke lever 33 in the closing position C.

As clockwise turning of the first control lever 51 progresses further after the choke lever 33 has been held in the closing position C, the first control lever 51 passes the elastic arm portion 52*c* of the second control lever 52 by causing the elastic arm portion 52*c* to bend, i.e., releasing the elastic arm portion 52*c*, to reach the second position E.

Figure 8:
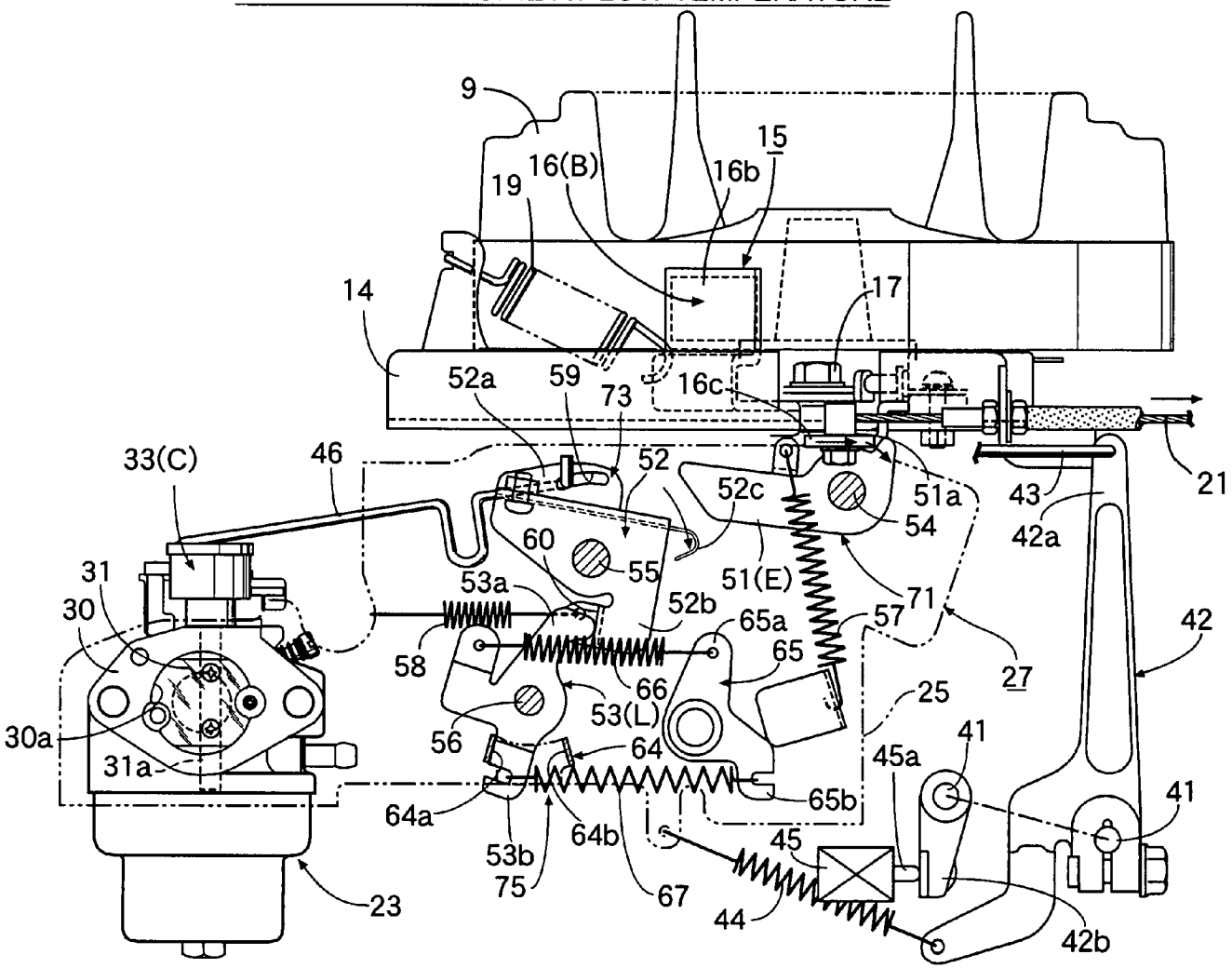
FIG. 8 is a diagram corresponding to FIG. 5, showing the state at a start of the engine at a low temperature.

The second control lever 52 thus released from the first control lever 51 is returned to the original position by the urging force of the second return spring 58 (see FIG. 8). At this time, the elongated hole 59 of the second control lever 52 moves relative to the link 46 connected to the choke lever 33. Therefore, the second control lever 52 can return to the original position without interference with the link 46, while leaving the choke lever 33 in the closing position C.

Thus, when the brake release lever 20 is operated to remove the force for braking the flywheel 9 of the engine 4, the choke lever 33 can be automatically held in the closing position C by being interlocked with the operation of the brake release lever 20. Therefore, it is not necessary for the operator to touch the choke lever 33 when starting the engine 4, and the operator is free from anxiety about forgetting closing the choke valve 31.

After operating the brake release lever 20, the recoil starter 11 is operated to crank the engine 4. At this time, the choke valve 31 is already in the completely closed state in the intake path 30*a* of the carburetor 23, and a fuel-rich air-fuel mixture suitable for a cold start is therefore generated. The engine 4 into which this air-fuel mixture is drawn can start rapidly.

Figure 9:
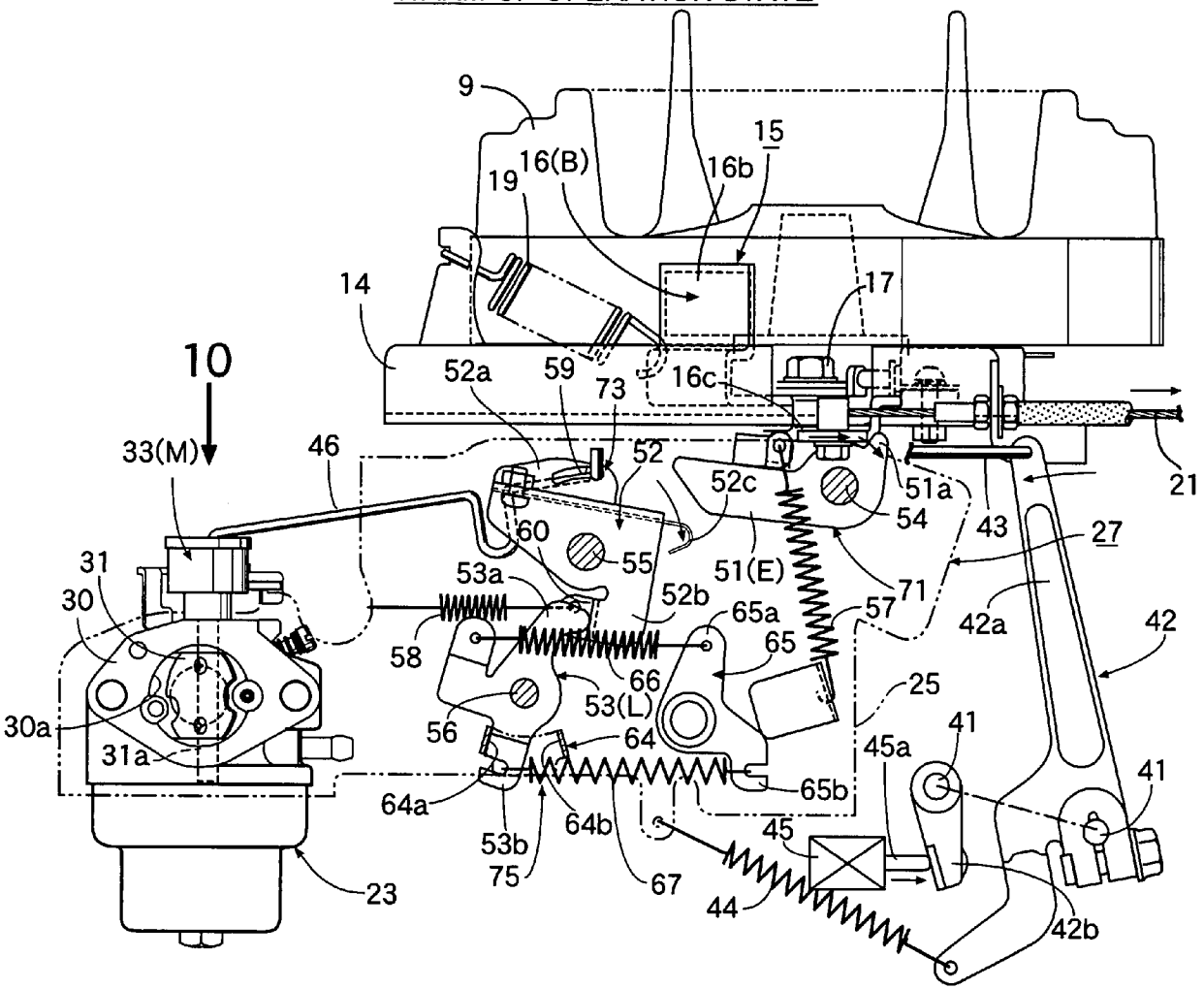
FIG. 9 is a diagram corresponding to FIG. 5, showing the state of the engine during warm-up operation.
Figure 10:
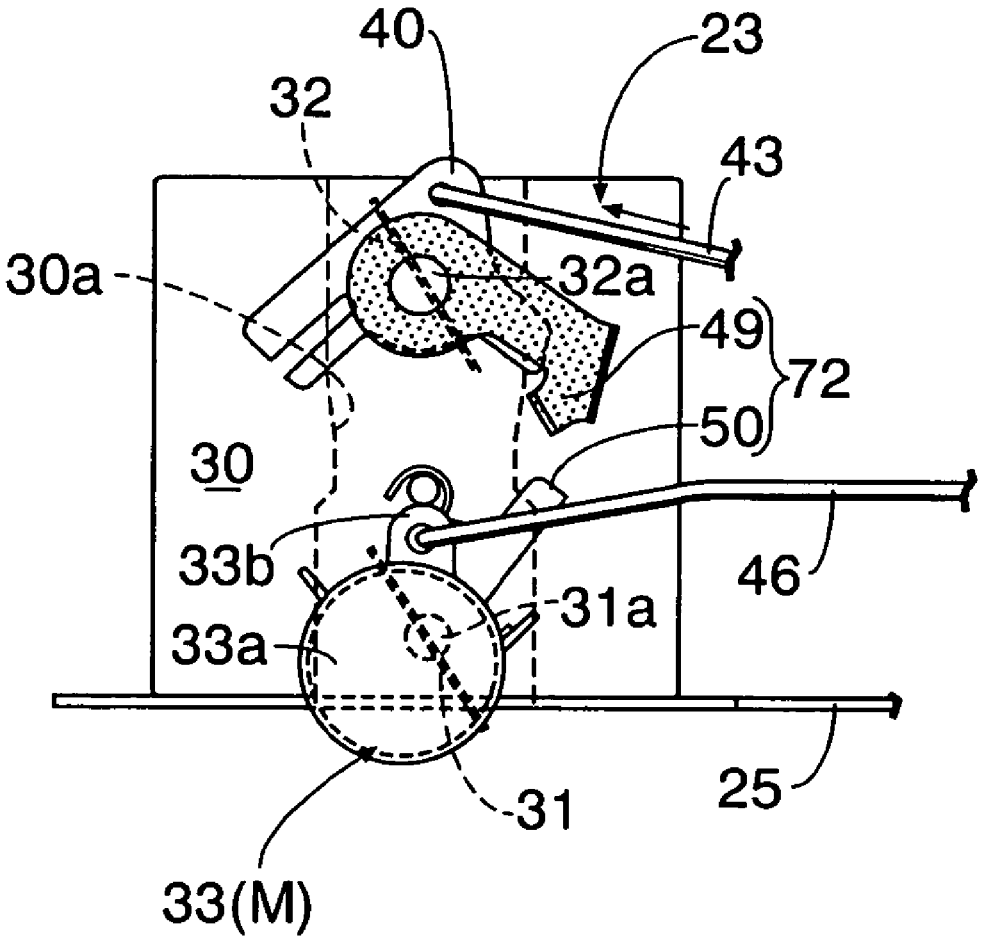
FIG. 10 is a diagram in the direction of the arrow 10 in FIG. 9.

As shown in FIGS. 9 and 10, the centrifugal governor 45 produces the output corresponding to the rotational speed of the crankshaft 5 when the engine 4 is started, and the governor lever 42 turns to a position at which the moment of the governor lever 42 due to this output and the moment of the governor lever 42 due to the load of the governor spring 44 balance with each other, thereby automatically closing the throttle vale 32. The locked arm 50 of the choke lever 33 is thereby released from the state of being locked by the lock arm 49 of the throttle lever 40. As a result, the choke lever 33 is turned by the urging force of the choke spring 39 so as to open the choke valve 31. However, the rightward movement of the link 46 with this turning, as viewed in FIG. 9, is limited by the right end wall of the elongated hole 59 of the second control lever 52, so that the choke valve 31 is held in a half opened state immediately after the start of the engine. Consequently, the concentration of fuel in the air-fuel mixture generated in the intake path 30*a* of the carburetor 23 is adjusted to a value suitable for engine warm-up operation to ensure a stable warm-up operation condition. Also, a deterioration of the fuel consumption rate due to a delay in opening the choke valve 31 can be avoided.

When the engine 4 is thus started, the crankshaft 5 drives and rotates the mowing blades 7 and the operator can perform a mowing operation by forcing forward the power lawn mower 1 while gripping the operating handle 6 and the brake release lever 20.

Figure 11:
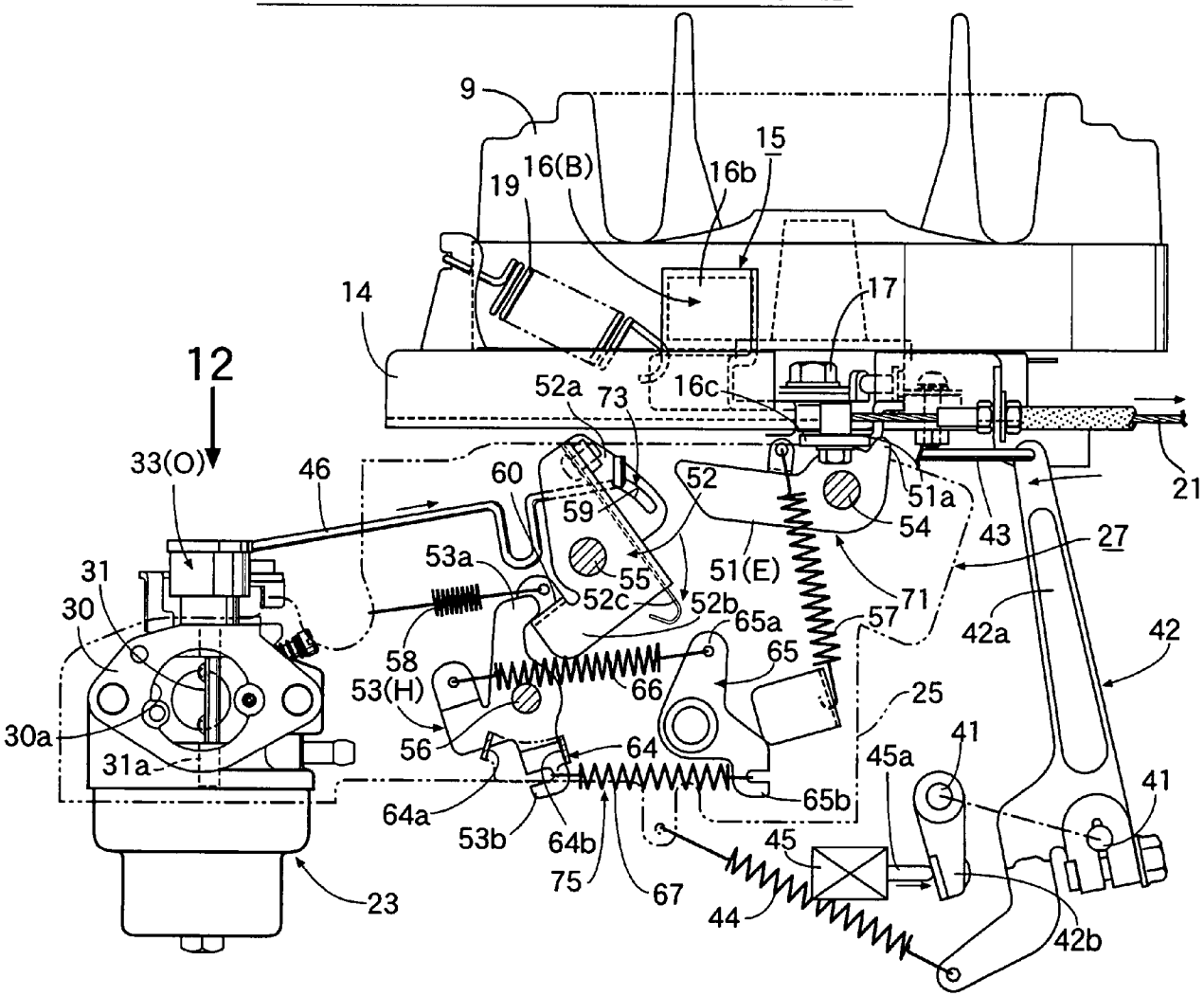
FIG. 11 is a diagram corresponding to FIG. 5, showing the state of the engine when warm-up operation is finished.
Figure 12:
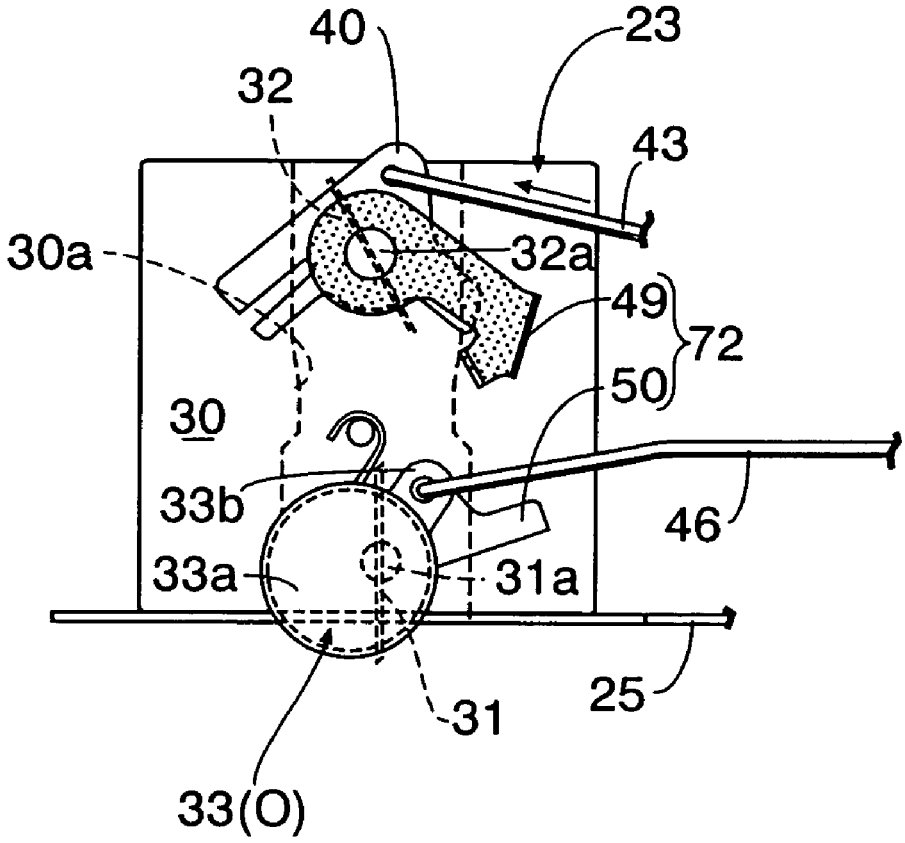
FIG. 12 is a diagram in the direction of the arrow 12 in FIG. 11.
Figure 13:
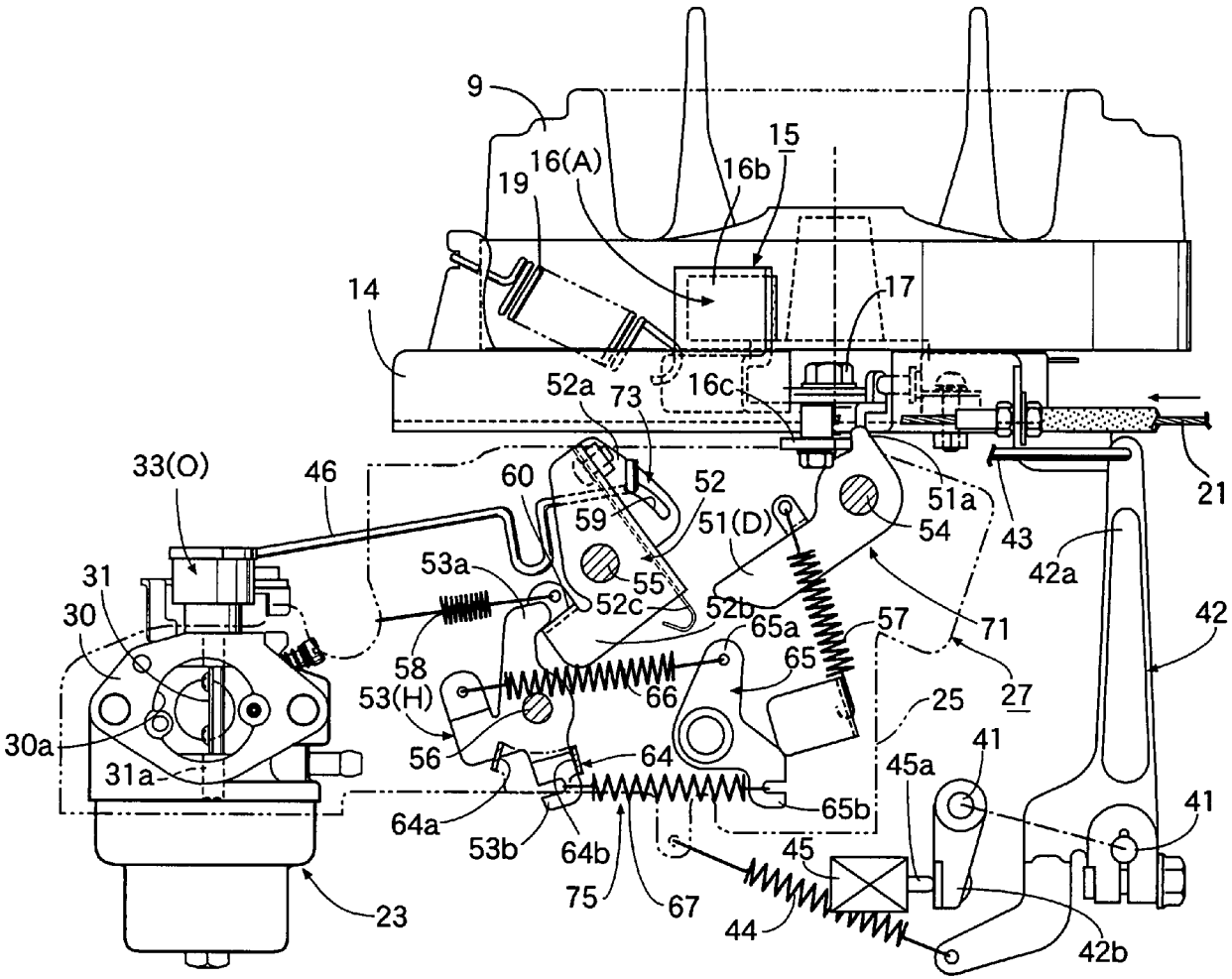
FIG. 13 is a diagram corresponding to FIG. 5, showing the state of the engine when the engine is stopped at a high temperature.

When the temperature of the engine becomes equal to or higher than a predetermined point by the warm-up operation, the ambient temperature also increases to heat the second control spring 67 at a temperature equal to or higher than the shape restoration temperature. The second control spring 67 then performs its proper spring function to generate a set load (tensile force) higher than that of the first control spring 66 and thereby turns counterclockwise the third control lever 53 to the high-temperature position H at which the lower arm portion 53*b* is brought into contact with the second stopper wall 64*b* against the set load of the first control spring 66, as shown in FIG. 11. The upper arm portion 53*a* of the third control lever 53 is thereby moved back from the contact wall 60 of the lower arm portion 52*b* of the second control lever 52. The second control lever 52 is then turned by the urging force of the second return spring 58 so as to follow the backward movement of the upper arm portion 53*a* to free the end of the link 46 in the elongated hole 59. Consequently, the choke lever 33 is turned to the opening position O by the urging force of the choke spring 39, thus automatically setting the choke valve 31 in the full open state to adjust the concentration of fuel in the air-fuel mixture generated in the carburetor 23 to the normal value. Since the shape restoration of the second control spring 67 is effected comparatively gradually with the increase in the engine ambient temperature, the transition of the choke valve 31 to the full open state is also effected gradually. Therefore, the concentration of fuel in the air-fuel mixture changes gradually. Thus, occurrence of an engine operation disorder due to an abrupt change in the concentration of fuel in the air-fuel mixture can be prevented.

As described above, the second control spring 67 made of a shape memory alloy is made to perform its proper spring function at the end of warm-up operation of the engine 4, to perform control for automatically setting the choke valve 31 in the full open state by using the third control lever 53 turned to the high-temperature position H. As a result, the opening of the choke valve 31 is controlled in a rational way according to the increase in engine temperature, thus satisfying both stabilization of engine warm-up operation and improvement of the fuel consumption rate.

This choke valve control device 27 is mechanically constituted by the first to third control levers, the first and second control springs 66 and 67, and other parts, and is comparatively simple in construction. Therefore this choke valve control device 27 can be provided at a reduced cost. Moreover, the control of the choke valve can be stabilized without being influenced by pulsation of the negative suction pressure in the engine.

When the operator looses his/her hold on the brake release lever 20 continuously pulled by the operator, the brake shoe 16 operates the engine kill switch 22 while being returned to the braking position A in which it is pressed against the flywheel 9 by the urging force of the brake spring 19. The engine 4 is thereby held immediately in the operation stopped state. At this time, the release arm 16*c* of the brake shoe 16 releases the claw portion 51*a* of the first control lever 51, and the first control lever 51 turns the claw portion 51*a* to the original position in which the claw portion 51*a* is engaged with the front end of the release arm 16*c* of the brake shoe 16 by the urging force of the first return spring 57. However, since the second control lever 52 is held by the third control lever 53 in the high-temperature position H, and has the elastic arm portion 52*c* positioned out of the turning path for the first control lever 52 51, it can return to the original position without contacting the elastic arm portion 52*c*.

Therefore, even when the brake release lever 20 is operated to the brake release position B to turn again the first control lever 51 to the second position E for the purpose of operating again the power working machine 1 before the engine 4 is cooled from a high-temperature condition, that is, while the engine 4 is in a hot condition, the second control lever 52 is positioned by the third control lever 53 in the high-temperature position H to maintain the choke lever 33 in the released position, i.e., the open position O. Therefore, in this state, if the recoil starter 11 is operated to crank the engine 4, a comparatively lean air-fuel mixture suitable for a hot start is generated in the intake path 30*a* of the carburetor 23, thus appropriately performing a hot start of the engine 4.

When the engine 4 is completely cooled after being stopped from operating, and the temperature of the second control spring 67 is reduced below the shape restoration temperature with the reduction in the engine ambient temperature, the spring 67 looses the spring function and, therefore, the third control lever 53 enters the state under the control with the first control spring 66 to be turned to the low-temperature position L. Then, with this turning, the upper arm portion 53*a* of the third control lever 53 returns the second control lever 52 to the original position against the urging force of the second return spring 58. With this operation, the choke lever 33 can return to the original position corresponding to the half opened state of the choke valve 31 as shown in FIGS. 4 and 5.

Figure 18A:
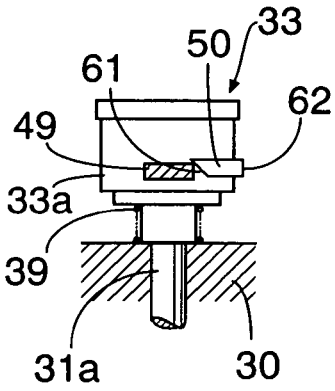
FIGS. 18A to 18C are diagrams corresponding to FIGS. 17A to 17C, showing a second embodiment of the present invention.
Figure 18B:
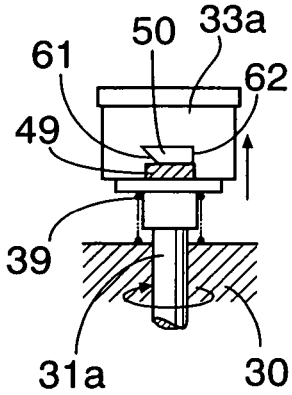
Figure 18C:
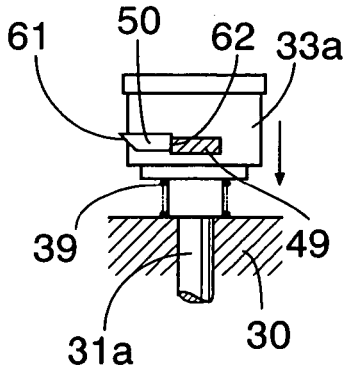

A second embodiment of the present invention shown in FIGS. 18A to 18C will be described.

The second embodiment uses, in the choke valve closed state hold means 72, expansion/contraction of the relief spring 36 (see FIG. 14) in the hub 33*a* of the choke lever 33 for the vertical movement of the locked arm 50. That is, while each of the lock arm 49 and the locked arm 50 is given rigidity, a sloping surface 61 having a gradient reverse to that in the first embodiment is formed as one side surface of the locked arm 50 formed integrally with the hub 33*a*. In other respects, the construction is the same as that of the first embodiment. Since the other components are the same as those in the first embodiment, portions corresponding to those in the first embodiment are indicated by the same reference numerals in FIGS. 18A to 18C.

When the choke lever 33 is turned toward the closing position C by the pulling operation of the brake release lever 20, the sloping surface 61 of the locked ark 50 contacts the lock arm 49 as shown in FIGS. 18(*a*) to 18(*b*). At this time, the sloping surface 61 is pressed upward by the lock arm 49. The hub 33*a* is thereby moved upward while compressing the relief spring 36, with the locked arm 50 passing above the lock arm 49. When the choke lever 33 reaches the closing position C, the hub 33*a* is returned to the lower position by the urging force of the relief spring 36, to bring the contact surface 62 of the locked arm 50 into contact with the lock arm 49, thus enabling the choke lever 33 to be held in the closing position C.

As described above in the description of the first and second embodiments, each choke valve closed state hold means 72 has the lock arm 49 provided continuously with the throttle lever 40 and the locked arm 50 provided continuously with the choke lever 33, the lock arm 49 and the locked arm 50 elastically surmounting each other when the choke lever 33 is turned to the closing position C in the state where the throttle lever 40 is in the opening position corresponding to the full open position of the throttle valve 32, so that the lock arm 49 prevents the locked arm 50 from turning back. Thus, the choke valve closed state hold means 72 is simple in construction and can contribute to a reduction in the manufacturing cost of the choke valve control device 27.

The present invention is not limited to the above-described embodiments. Various changes can be made in the design of the device within the scope not departing from the subject matter of the invention.

What is claimed is:

1. A device for controlling a choke valve of a carburetor annexed to an engine, comprising choke closed state hold means for holding, in a closing position corresponding to the completely closed position of the choke valve, a choke lever connected to the choke valve and urged by a spring in a direction for opening the choke valve, when the choke lever is turned to the closing position, the choke closed state hold means releasing the choke lever from the held state by a throttle operation of the carburetor after a start of the engine, wherein the choke closed state hold means includes a lock arm provided continuously with a throttle lever connected to a throttle valve of the carburetor, and a locked arm provided continuously with the choke lever, the lock arm and the locked arm elastically surmounting each other when the choke lever is turned to the closing position in a state where the throttle lever is in the opening position corresponding to a full open position of the throttle valve, so that the lock arm prevents the locked arm from turning back; a governor spring which urges the throttle lever in a direction for opening the throttle valve and a governor which produces an output for urging the throttle lever in a direction for closing the throttle valve according to an increase in the rotational speed of the engine are connected to the throttle lever; and the lock arm releases the locked arm by turning of the throttle lever in the direction for closing the throttle lever by the output from the governor.

2. The device according to claim 1, further comprising a braking mechanism for stopping the rotation of an output shaft of the engine; brake release means manually operated so as to release the braking mechanism from the operating state; a choke spring which urges the choke valve in the direction for opening the choke valve, and which is connected to the choke valve; automatic choke valve opening means for automatically opening, in cooperation with the choke spring, after a start of the engine, the choke valve held in the closed position immediately before the start of the engine, the automatic choke valve opening means being also connected to the choke valve; and automatic choke valve closing means for turning the choke valve to the closed position in interlock with the operation of the brake release means, the automatic choke valve closing means being provided between the choke valve and the brake release means.

3. The device according to claim 2, wherein the automatic choke closing means includes a first control lever which is axially supported on a fixed structural member of the engine, and which turns to a first position and a second position by being interlocked with non-operative and operative states of the brake release means, and a second control lever which is axially supported on the fixed structural member, and which, when the first control lever turns to the second position, is thereby driven to turn the choke lever connected to the choke valve to the position for closing the choke valve and is thereafter released from the first control lever; the device further comprising a return spring which urges the second control lever in a direction for opening the choke valve and which is connected to the second control lever, and lost motion means for leaving the choke lever in the closing position when the second control lever is returned by the return spring, the lost motion means being provided between the second control lever and the choke lever.

* * * * *